US006018325A

United States Patent [19]

Lundgren

[11] Patent Number: 6,018,325

[45] Date of Patent: Jan. 25, 2000

[54] MONOPOLE ANTENNA MOUNTING SYSTEM

[75] Inventor: Carl W. Lundgren, Colts Neck, N.J.

[73] Assignee: AT&T Corp, New York, N.Y.

[21] Appl. No.: 08/949,919

[22] Filed: Oct. 14, 1997

[51] Int. Cl.[7] ..... H01Q 1/12

[52] U.S. Cl. ..... 343/890; 343/878; 343/891

[58] Field of Search ..... 343/708, 709, 343/710, 880, 881, 883, 884, 885, 886, 878, 890, 891, 892; 52/40, 301; 248/159, 188.5; H01Q 1/12

[56] References Cited

U.S. PATENT DOCUMENTS

| | | | |
|---|---|---|---|
| 1,852,925 | 4/1932 | Gomery | 343/891 |
| 1,981,339 | 11/1934 | Vrooman | 343/891 |
| 2,062,846 | 12/1936 | Venable | 250/33 |
| 2,497,065 | 2/1950 | Braddon | 343/890 |
| 2,508,648 | 5/1950 | O'Brien et al. | 343/890 |
| 2,510,059 | 6/1950 | Black | 189/21 |
| 3,579,244 | 5/1971 | Dempsey | 343/846 |
| 3,605,105 | 9/1971 | Penzias | 343/839 |
| 3,605,108 | 9/1971 | Crawford | 343/882 |
| 4,146,897 | 3/1979 | Wilson et al. | 343/882 |
| 5,097,647 | 3/1992 | Sopik et al. | 52/648 |
| 5,537,125 | 7/1996 | Harrell, Jr. et al. | 343/878 |

*Primary Examiner*—Don Wong
*Assistant Examiner*—Tho Phan

[57] ABSTRACT

An antenna mounting system has a pole secured at a first end to a base. A platform is connected to the pole via a tiltable joint which is rotationally fixed with respect to the pole. An antenna is secured to the platform, having a beam which is aligned to a desired elevation and azimuth orientation. Three flexible cables are connected at their first ends to the platform and at their second ends to a fixed reference plane mounting member which is rotationally fixed to the pole nearer its first end. The force of high winds will cause the pole to bend and, if unaccounted for, change the planar orientation of the platform and mispoint the beam. The platform, mounting member, and cables form a system of parallelograms whose sides remain parallel when the pole is deflected. Thus, the platform maintains its original angular orientation as the pole bends, preserving the desired orientation of the beam.

32 Claims, 6 Drawing Sheets

MONOPOLE ANTENNA MOUNTING SYSTEM

INTRODUCTION

The present invention is directed to a monopole antenna mounting system and, more particularly, to a monopole antenna mounting system having improved stabilization.

BACKGROUND

Antennas are commonly mounted atop a self-supported mast or pole. These structures are subject to swaying and bending under high wind loading, thereby mispointing the antenna in both elevation due to bending of the pole and azimuth orientation due to twisting of the antenna. This can be a severe problem in the application of point-to-point microwave directive antennas whose narrow beams must be precisely aligned. Moreover, monopole antennas are frequently polarized to permit the reception of a single signal and block signals polarized at different angles. The mispointing of monopole antennas can be addressed via construction of larger, stiffer, and more costly poles and/or guying the pole, which requires additional space, lacks aesthetic appeal and can have a negative environmental impact.

One antenna support is proposed in U.S. Pat. No. 3,605,108 to Crawford which discloses an antenna platform supported by a universal joint on a pole fixed to a foundation. Three rods extend between the foundation and the platform parallel to the pole. The rods have structural properties such that they deflect in a manner similar to the pole. A plurality of spacers provide a constant separation between the pole and the rods, and maintain the rods in parallel with the pole along their entire length. This complex construction produces additional compression and bending forces on the base due to the weight of the rods and their rigid connection to the base, and does not accommodate settling of the tower.

Another antenna support is proposed in U.S. Pat. No. 3,605,105 to Penzias which discloses an antenna platform supported on a pole. A flexible belt runs within the pole. The belt crosses itself as it passes from an antenna mirror down to the base and back via a system of pulleys. As the pole deflects, one portion of the belt lengthens while the other shortens, thereby rotating the antenna mirror. Such a complex system cannot easily be retrofitted to existing antenna support poles since the belt must run within the pole. For an antenna platform supporting multiple antennas, a complex belt and pulley system must be installed for each antenna, and correctly aligned with the orientation of that particular antenna.

Another antenna support is proposed in U.S. Pat. No. 2,510,059 to Black which discloses a self-leveling platform supported by a universal joint on a tower. A plurality of parallel rods are connected between the platform and the base. This construction is also complex and produces compression and bending forces on the base due to its weight and the direct rigid connection of the rods to the platform and the base, and does not accommodate settling of the tower.

It is an object of the present invention to provide an antenna mounting system which reduces or wholly overcomes some or all of the aforesaid difficulties inherent in prior known devices. Particular objects and advantages of the invention will be apparent to those skilled in the art in view of the following disclosure of the invention and detailed description of certain preferred embodiments.

SUMMARY

The principles of the invention may be used to advantage to provide a mounting system for an antenna which reduces the mispointing effects on the antenna due to wind forces. A pole having first and second ends is secured at its first end to a base and a joint is secured to the pole. The joint is rotationally fixed with respect to the pole. A platform for supporting an antenna is supported by the joint. A mounting member is secured to the pole intermediate the pole's first and second ends. A plurality of lines are spaced angularly equally about a longitudinal axis of the pole and secured at first ends to the platform and at second ends to the mounting member.

The principles of the invention may also be used to advantage to provide a mounting system for an antenna comprising a pole having first and second ends and being rigidly secured at its first end. A joint is secured to the pole and a platform for supporting an antenna is operably connected to the joint. The joint is rotationally fixed with respect to the pole. A plurality of lines in tension are spaced angularly equally about a longitudinal axis of the pole, being secured at first ends thereof to the platform and at second ends thereof to a fixed location.

The principles of the invention may also be used to advantage to provide a mounting system for an antenna comprising a pole having first and second ends and being secured at the first end to a base. A joint is secured to the pole intermediate its first and second ends. The joint is rotationally fixed with respect to the pole. A platform for supporting an antenna is operably connected to the joint and a mounting member is secured to the pole intermediate the joint and the base. Three flexible cables in tension are spaced angularly equally about a longitudinal axis of the pole, each being secured at a first end to the platform and at a second end to the mounting member. An adjustment means positions the platform in a predetermined planar orientation, and establishes a predetermined tension in the cables.

From the foregoing disclosure, it will be readily apparent to those skilled in the art that the present invention provides a significant technological advance. Antenna mounting systems as described herein can provide low-cost, effective, environmentally sound devices which passively maintain the beam pointing of directive antennas mounted on swaying support structures such as poles. These systems can also account for the settling of sections of telescoping poles upon which the antennas are mounted, preserving the desired orientation of the antennas' beams. These systems can advantageously be used with any type of pole without regard to the structural properties of the pole. These and further additional features and advantages of the invention will be further understood from the following detailed disclosure of certain preferred embodiments.

BRIEF DESCRIPTION OF THE DRAWINGS

Certain preferred embodiments are described in detail below with reference to the appended drawings wherein.

Figure 1:
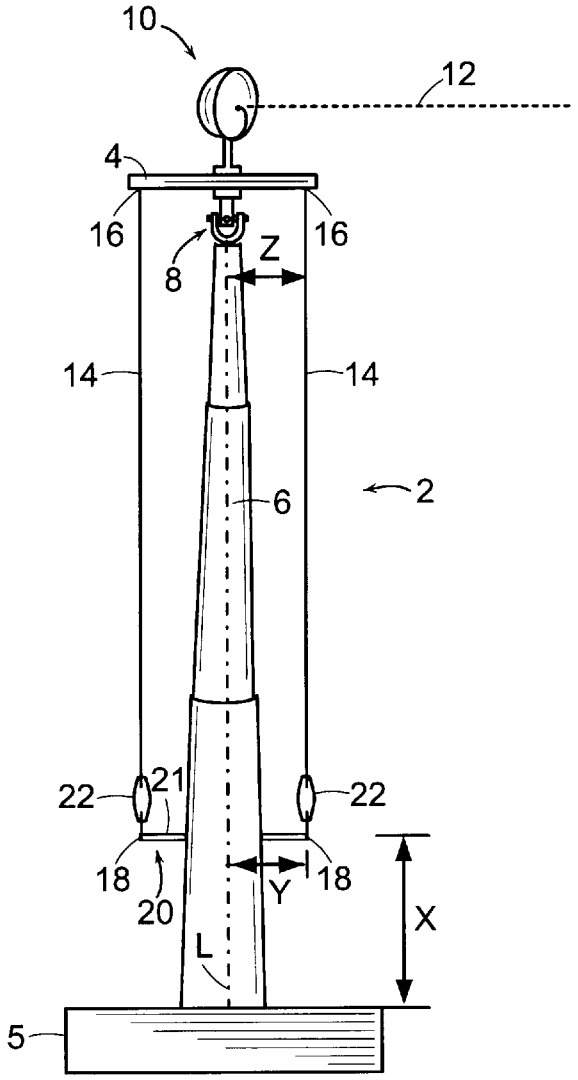
FIG. 1 is a schematic elevation view of the antenna mounting system of the present invention in a static condition.

The figures referred to above are not necessarily drawn to scale and should be understood to present a representation of the invention, illustrative of the principles involved. Some features of the antenna mounting system depicted in the drawings have been enlarged or distorted relative to others to facilitate explanation and understanding. The same reference numbers are used in the drawings for similar or identical components and features shown in various alternative embodiments. Antenna mounting systems as described here, will have configurations and components determined, in part, by the intended application and environment in which they are used.

DETAILED DESCRIPTION OF CERTAIN PREFERRED EMBODIMENTS

Unless otherwise stated, or otherwise clear from the context below, directional references used here are based on the orientation of components and assemblies shown in the appended drawings. These directional references assume a vertically mounted pole secured to a base.

An antenna mounting system 2, as seen in FIG. 1, comprises a platform 4 supported on top of a pole 6 and connected thereto by a tiltable pivot member such as joint 8. Pole 6 is preferably formed of multiple telescoping sections and is secured at a first end thereof to base 5. Joint 8 is preferably rotationally fixed about pole 6 so that in a static condition joint 8 resists rotation about longitudinal axis L of pole 6. In the illustrated embodiment, joint 8 is a universal joint which allows rotation about its pivot pins, which are substantially perpendicular to one another, but not about a vertical axis, namely longitudinal axis L.

An antenna 10 is secured to platform 4 and may be, as illustrated, a parabolic antenna with a beam 12. Antenna 10 may be rigidly secured to platform 4 or adjustably secured to permit optimization (locally or remotely) of the azimuth, elevation, and/or polarization of beam 12. Joint 8 prevents unwanted deviation of beam 12 in a horizontal direction, i.e. maintaining its azimuthal orientation, which can be critical in point-to-point antenna applications. A plurality of lines 14, preferably at least three, flexible lightweight wires or cables, are secured at first ends 16 to platform 4 a distance Z from longitudinal axis L of pole 6, and at second ends 18 to mounting member 20, which provides a reference plane for platform 4, a distance Y from longitudinal axis L, thereby providing tension in lines 14 which ensures stability of platform 4. Lines 14 are spaced angularly equally about longitudinal axis L of pole 6, as seen best in FIG. 6. This accommodates the deflection of pole 6 due to wind from any direction and also allows multiple antennas 10 to be mounted to platform 4 while maintaining the correct orientation for each of them. The symmetry of lines 14 about pole 6 further reduces any azimuth changing effects of the wind on antenna 10. A turnbuckle 22, or other tension adjustment means, is provided in each line 14 in order to position platform 4 in a desired planar orientation and align beam 12. In a preferred embodiment, turnbuckles 22 are adjusted so that platform 4 is substantially horizontal. Mounting member 20 is positioned a height X above base 5, and, in certain preferred embodiments, comprises a plurality of rigid rods 21 which extend radially from pole 6, with second ends 18 of lines 14 secured to rods 21. Mounting member 20 is preferably closer to base 5 than platform 4 so as to minimize the effect of any bending of pole 6 on mounting member 20. Mounting member 20 is preferably rotationally fixed about pole 6 in order to maintain the original azimuthal orientation of beam 12.

Figure 2:
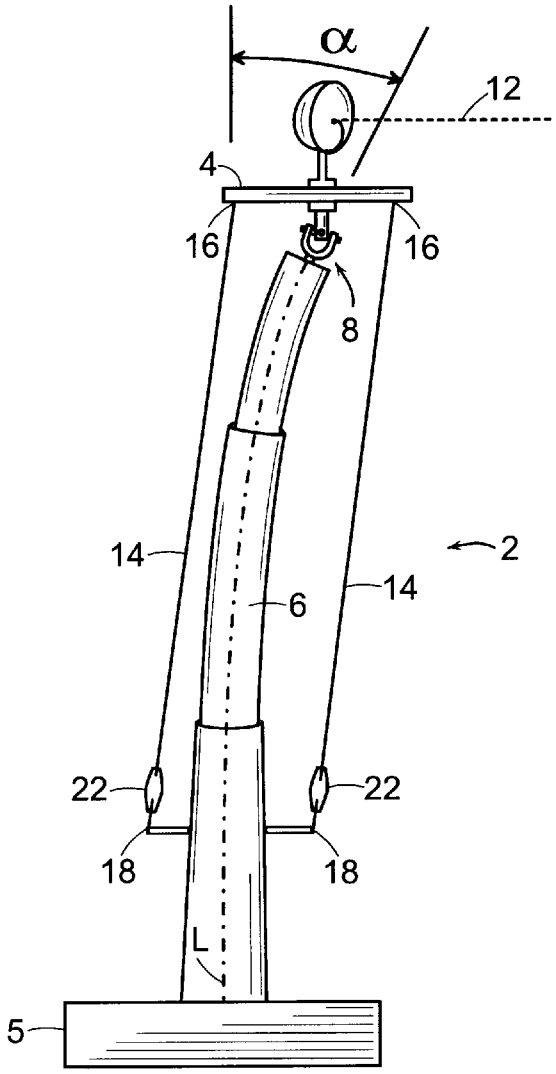
FIG. 2 is a schematic elevation view of the antenna mounting system of FIG. 1 in a dynamic condition showing the effects of wind forces.

In a preferred embodiment, Y and Z are substantially equal so that lines 14 are substantially parallel to one another and longitudinal axis L of pole 6. As seen in FIG. 2, when undergoing high wind forces, pole 6 is deflected from its static vertical position by an angle $\alpha$ (shown here deflected an exaggerated amount to illustrate the principles of the invention). In a typical application, the effective pole bending angle $\alpha$ is approximately 5° at a wind speed of approximately 80 mph, wherein the greatest pole deflection occurs nearest joint 8. Without proper compensation, platform 4, and correspondingly beam 12 and its polarization, would be deflected by an equal angle in a worst case. Lines 14, mounting member 20, and platform 4 form a parallelogram which, when moved from its original static position, maintains the parallel relationship between its opposing sides. Since there are preferably at least three lines 14, a system of parallelograms is formed, the sides of which remain parallel when the pole is deflected, which enables antenna mounting system 2 to account for wind from any direction. In the illustrated embodiment, with the wind blowing from left to right, lines 14 are deflected such that they cant toward the right while remaining parallel to one another. Similarly, platform 4 and mounting member 20 remain parallel to one another. This enables platform 4 to remain in its original position, e.g. horizontal, and preserve the original desired elevation and polarization of beam 12 of antenna 10. Simultaneously joint 8 preserves the azimuth orientation of beam 12.

In another preferred embodiment, lines 14 are of different lengths so that platform 4 is non-horizontal in a static condition, i.e. when there is no wind, and horizontal in a dynamic condition, i.e. under wind loading. For a given distance Z, distances X and Y can be optimized based on the bending characteristics of pole 6, antenna 10 and the other components of mounting system 2 so that under a designed wind speed, platform 4 becomes horizontal (or precisely tilted at a desired angle). Specifically, the distance Y is greater than the distance Z in situations where over correction is desired, i.e. where platform 4 tilts in a direction away from the direction of the bend of pole 6. The distance Y is less than the distance Z when under correction is desired, i.e. where platform 4 tilts in the same direction of the bend of pole 6. As distance X increases, the length of lines 14 decreases and distance Y correspondingly needs to be increased to obtain a desired correction. Varying these distances, therefore, permits the total system performance to be optimized over a wide range of wind speeds.

Figure 3:
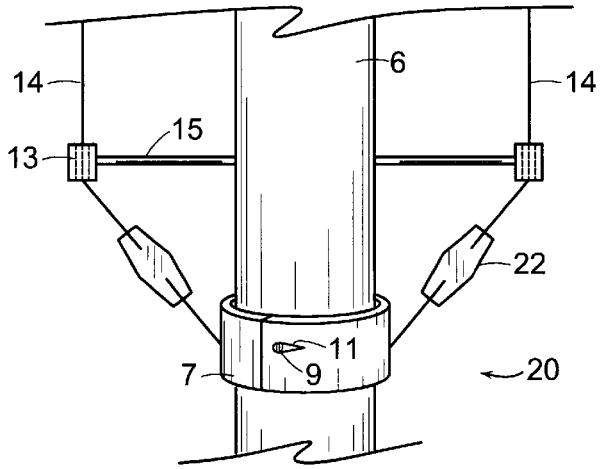
FIG. 3 is a schematic perspective view of an alternative mounting member of the antenna mounting system of FIG. 1.

Mounting member 20 may, in certain preferred embodiments, be comprised of a cylindrical clamp 7 secured about pole 6, as seen in FIG. 3. Clamp 7 comprises two mating semi-circular halves secured to one another by a fastener 9 which is positioned in a countersunk bore 11. Lines 14 slidingly engage bores 13 formed in first ends of stays 15 which are secured to pole 6 at second ends thereof.

Figure 4:
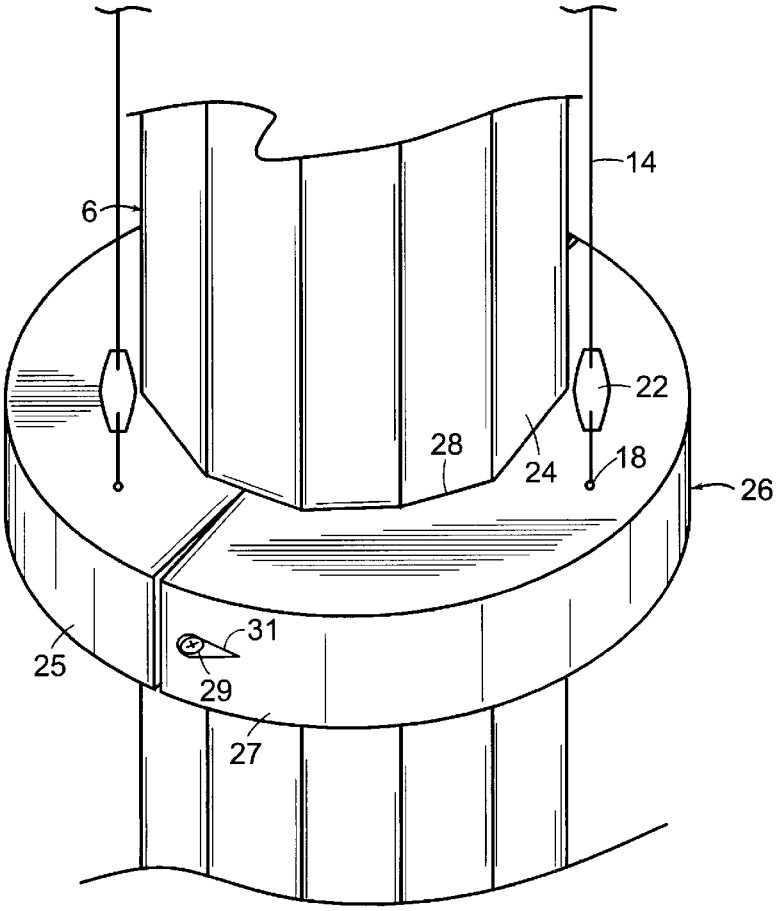
FIG. 4 is a schematic perspective view of an alternative embodiment of the mounting member included the antenna mounting system of FIG. 1.

In another preferred embodiment, seen in FIG. 4, mounting member 20 is axially slidable along as well as rotationally fixed about pole 6. In the illustrated embodiment, pole 6 is formed of a plurality of sections 24 thus creating a polygonal cross-section. Mounting member 20 comprises a substantially cylindrical base member 26 positioned about pole 6 to which second ends 18 of lines 14 are secured. The interior surface of base member 26 is formed of facets 28 which mate with sections 24 of pole 6. Facets 28 of base member 26 slide along the faces of sections 24 as base member 26 moves axially along pole 6. This mating engagement of facets 28 and sections 24 prevents rotation of base member 26 about pole 6, thereby avoiding forces which would tend to disturb the azimuthal orientation of antenna 10. The weight of base member 26 pulls downwardly and therefore maintains tension in lines 14 which compensates for any settling of the telescoping sections of pole 6. The tension in lines 14 maintains the original planar orientation of platform 4, thereby preserving the desired vertical orientation of antenna 10. Base member 26 preferably comprises of a first section 25 and a mating second section 27 which are secured to one another by fastener 29 which rests in countersunk bore 31. The two mating sections 25, 27 allow base member 26 to be assembled about an existing pole 6 without needing to slip base member over the top of pole 6 and slide it downwardly to its desired location.

Figure 5:
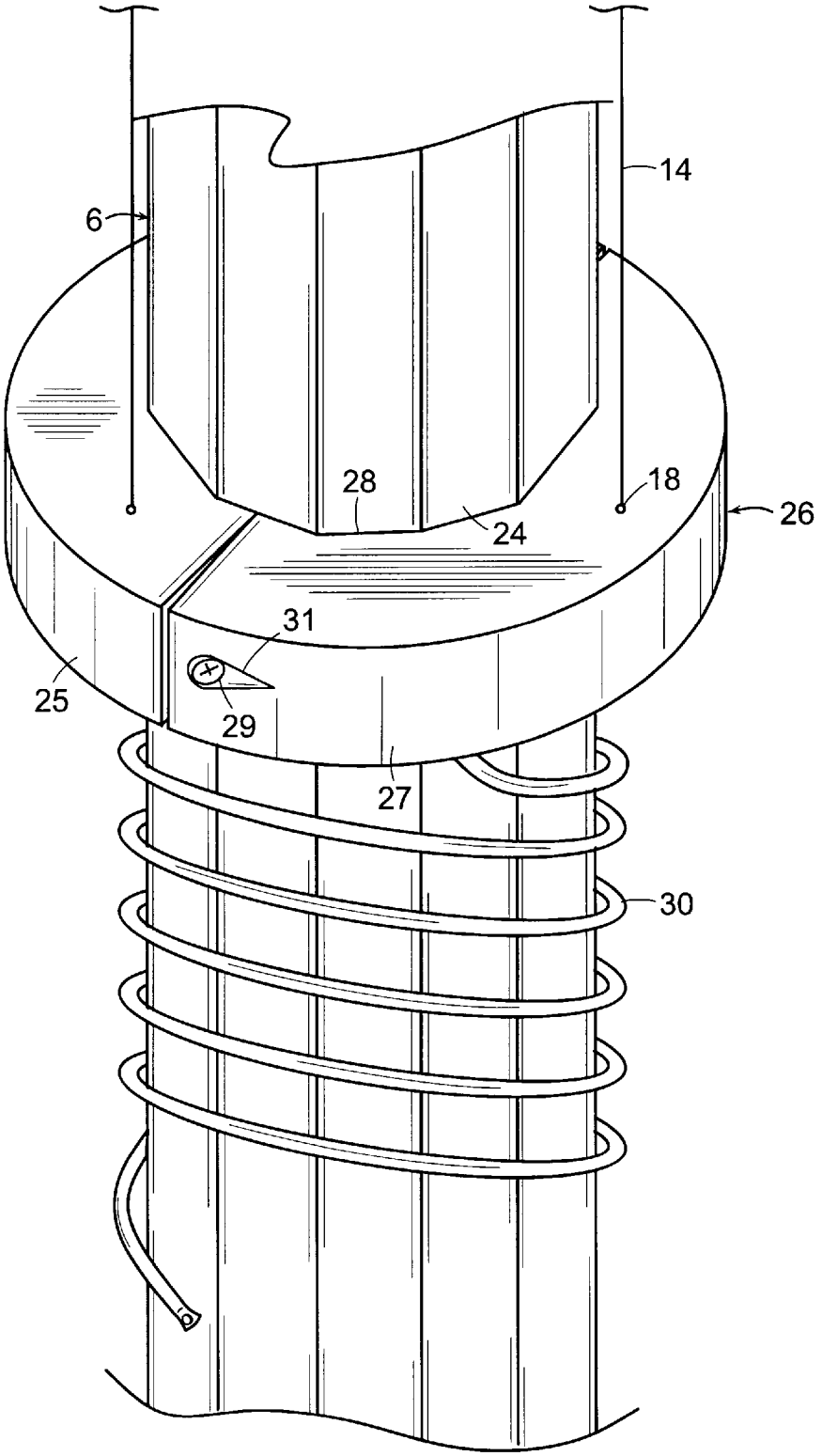
FIG. 5. is a schematic perspective view of another alternative embodiment of the mounting member included in the antenna mounting system of FIG. 1.

In another preferred embodiment, seen in FIG. 5, spring 30 is disposed about pole 6, secured at a first end thereof to base member 26 and at a second end thereof to pole 6. Spring 30 is in tension and therefore helps maintain tension in lines 14 by pulling downwardly on base member 26, acting in a similar manner as that shown in FIG. 4 to preserve the orientation of antenna 10. In other preferred embodiments, spring 30 could be positioned above base member 26 and act in compression to maintain tension in lines 14 and preserve the orientation of antenna 10.

Figure 6:
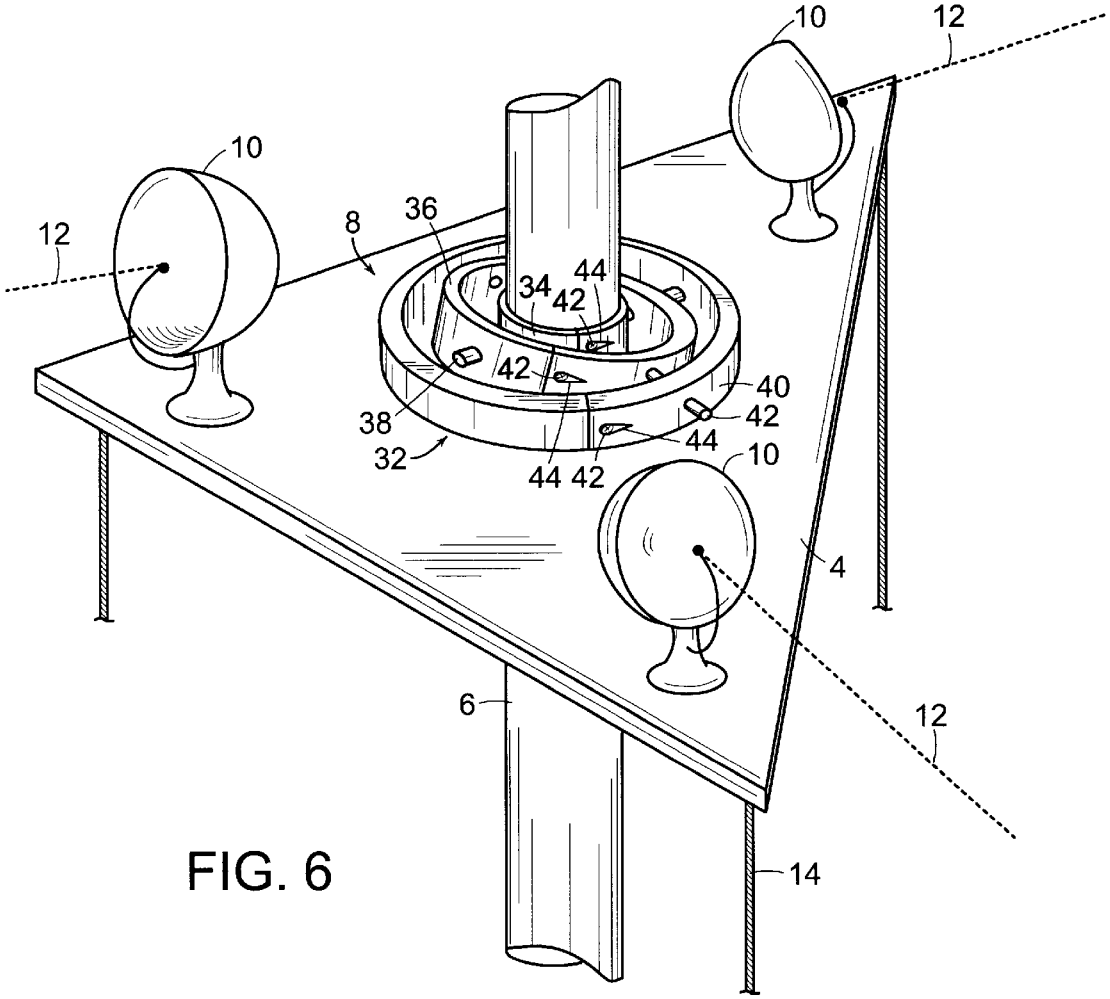
FIG. 6 is a schematic perspective view of an alternative embodiment of the joint and platform included in the antenna mounting system of FIG. 1.

An alternative preferred embodiment is seen in FIG. 6 where platform 4 is positioned below the top of pole 6. Three lines 14 are spaced angularly equally 120° apart around pole 6. In the illustrated embodiment, platform 4 has three antennas 10 secured thereto and is operably connected to joint 8 which comprises gimbal 32. Gimbal 32 comprises clamp 34 secured to pole 6 and having first axles 38 which extend radially outwardly therefrom. Inner member 36 pivots about first axles 38 and has second axles 42 which extend radially outwardly therefrom. Platform 4 is secured to outer member 40 which pivots about second axles 42. Gimbal 32 works in a known fashion to allow manipulation of the planar orientation of platform 4 while preventing rotation of platform 4 about pole 6. Antennas 10 can therefore be precisely positioned to align beams 12 in a desired orientation. Clamp 34, and inner and outer members 36, 40 are preferably formed of semi-circular halves which are secured to one another by fasteners 42 positioned in countersunk bores 44. The symmetric semi-circular halves allow gimbal 32 to be mounted about pole 6, thereby preventing the need to slide a pre-assembled gimbal 32 down over the top of pole 6.

An advantage of the present invention is the fact that multiple antennas can be moutned to the platform at any time. Antennas can be installed simultaneously with the installation of the antenna mounting system, or at a later time without the need to alter the previously installed antenna mounting system. The symmetrical aspect of the system allows compensation for wind from any direction, thereby enabling the system to maintain the desired orientation of each of the antennas regardless of the orientation of its particular antenna beam.

Figure 7:
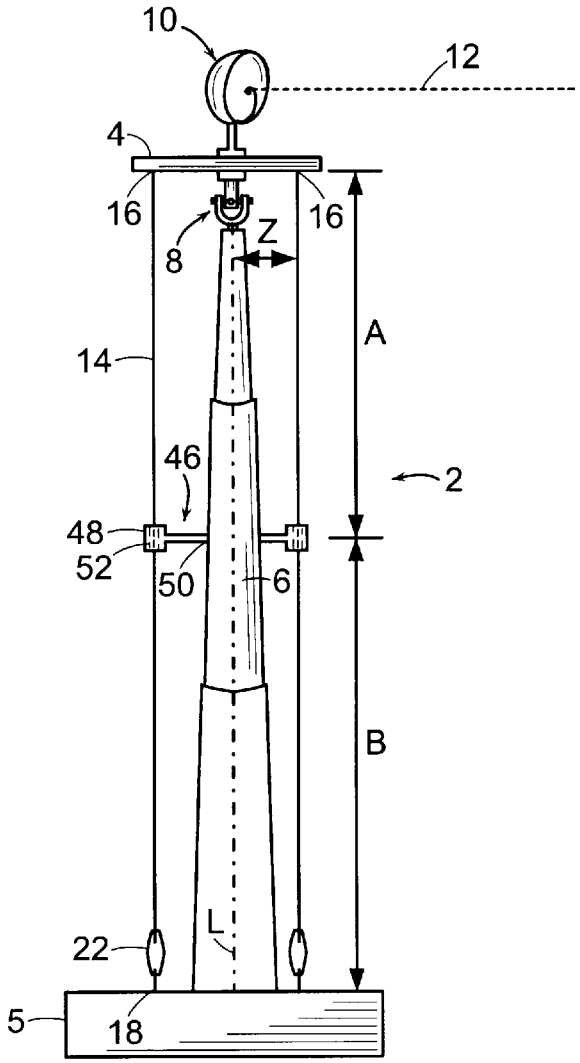
FIG. 7 is a schematic elevation view of an alternative embodiment of the antenna mounting system of FIG. 1.
Figure 8:
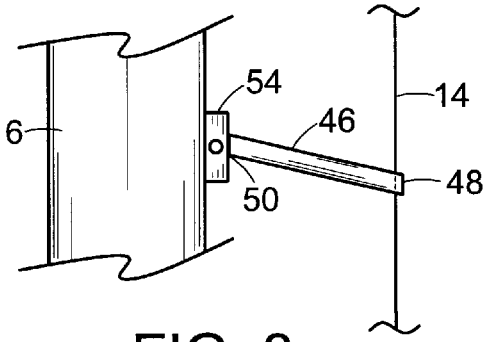
FIG. 8 is a schematic elevation view of an alternative embodiment of the stay included in the antenna mounting system of FIG. 7.

In another preferred embodiment, as seen in FIG. 7, lines 14 are secured in tension at second ends 18 directly to base 5. A plurality of guide members or stays 46 are provided intermediate platform 4 and mounting member 20 to prevent excessive vibration in lines 14. Stay 46 is operably connected to line 14 at first end 48 thereof and to pole 6 at second end 50 thereof. Line 14 freely passes through bore 52 formed at first end 48. Stays 46 are preferably spaced below first ends 16 of lines 14 a distance A, and above second ends 18 of lines 13 a distance B which is different than distance A. This difference creates an unequal stabilizing line length, i.e. the unencumbered length of any portion of lines 14. Having such different lengths avoids the undesirable resonance build-up of wind induced oscillations which in turn could produce destructive vibrations in antenna mounting system 2. Stays 46 may, in certain preferred embodiments, as seen in FIG. 8, be rigidly secured to lines 14 at first end 48, and pivotally connected to pole 6 at second end 50 via hinge 54.

Figure 9:
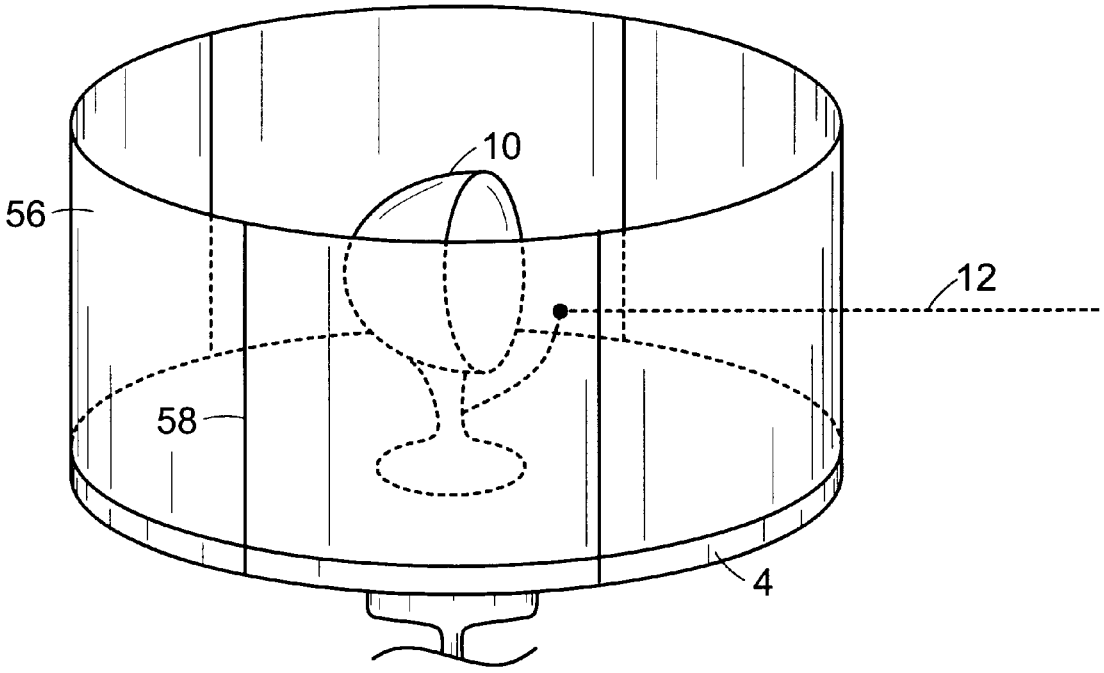
FIG. 9 is a schematic perspective view of a shroud secured to the platform included in the antenna mounting system of FIG. 1.

An alternative preferred embodiment is shown in FIG. 9, where shroud 56 is positioned on platform 4 surrounding antenna 10. Shroud 56 is supported by frame 58 and provides protection from azimuth rotating wind forces incurred by antenna 10. Shroud 56 preferably has a symmetric profile, such as the cylindrical shape of the illustrated embodiment, in order to deflect wind equally well from any direction. Shroud 56 comprises a rain-shedding, radio wave transparent (radome) material, such as Teflon® manufactured by Dupont, which provides shielding from the wind while allowing beam 12 to pass therethrough unimpeded.

In another preferred embodiment, base 5 could be mounted vertically to a tower or other structure, such as a building, and pole 6 would, therefore, extend horizontally. In this embodiment, FIGS. 1 and 2 would represent top plan views of antenna mounting system 2. Joint 8 would, therefore, resist rotation about a horizontal axis, namely longitudinal axis L of pole 6. Lines 14 would cooperate with mounting member 20 and platform 4 to resist azimuth changing wind forces and maintain the original desired orientation of beam 12. Since lines 14 are preferably lightweight cables, their added weight would produce little effect on the orientation and positioning of antenna mounting system 2.

Such antenna mounting systems can advantageously be used to retrofit any number of existing poles or towers, since the components of the antenna mounting system of the present invention need not be specifically matched to the structural properties of the pole or tower with which it is associated. Another advantage of this system is its light weight and portability. Such a system can advantageously be used in many applications, including portable microwave antenna installations, e.g. microwave antennas supported by extendable poles secured to a stabilized van or truck. The light weight and increased stability of such systems can allow for increased heights of portable antenna poles, and therefore, greater flexibility in their application and performance.

In light of the foregoing disclosure of the invention and description of certain preferred embodiments, those who are skilled in this area of technology will readily understand that various modifications and adaptations can be made without departing from the true scope and spirit of the invention. All such modifications and adaptations are intended to be covered by the following claims.

I claim:

1. A mounting system for an antenna, comprising, in combination:

a pole having a first end and a second end, the first end being rigidly secured;

a joint secured to the pole and being rotationally fixed with respect to the pole;

a platform for supporting an antenna supported by the joint;

a mounting member secured to the pole intermediate its first and second ends; and a plurality of lines spaced angularly equally about a longitudinal axis of the pole, each secured at a first end thereof to the platform and at a second end thereof to the mounting member.

2. A mounting system in accordance with claim 1, wherein the lines comprise at least three lines.

3. A mounting system in accordance with claim 1, wherein the lines comprise flexible cables.

4. A mounting system in accordance with claim 1, wherein the lines are substantially parallel to the longitudinal axis of the pole.

5. A mounting system in accordance with claim 1, wherein the joint is operably connected to the pole intermediate the pole's first and second ends.

6. A mounting system in accordance with claim 5, wherein the joint comprises a gimbal.

7. A mounting system in accordance with claim 1, further comprising adjustment means to position the platform in a predetermined planar orientation.

8. A mounting system in accordance with claim 7, wherein the adjustment means comprises a turnbuckle disposed in each line.

9. A mounting system in accordance with claim 1, wherein the mounting member is rotationally fixed about the pole and axially slidable along the pole and further comprising means for maintaining tension in the lines.

10. A mounting system in accordance with claim 9, wherein the pole comprises a plurality of sections creating a polygonal cross-section, the mounting member comprises a base member having a faceted interior surface, the facets of the interior surface mating with and sliding axially along exterior surfaces of the sections, the means for maintaining tension comprising the weight of the mounting member.

11. A mounting system in accordance with claim 9, wherein the means for maintaining tension comprises a spring operably connected to said mounting member and said pole.

12. A mounting system for an antenna in accordance with claim 1, further comprising a rain-shedding radio wave transparent shroud surrounding the antenna and having a symmetric profile to reduce azimuth changing effects of wind on the antenna.

13. A mounting system in accordance with claim 1, wherein the lines are configured such that the platform is non-horizontal when the pole is in a static vertical condition and substantially horizontal when the pole is bent from its static vertical position a predetermined angle.

14. A mounting system in accordance with claim 1, wherein the first ends of the lines are spaced from the longitudinal axis of the pole a distance greater than a distance the second ends of the lines are spaced from the longitudinal axis.

15. A mounting system in accordance with claim 1, wherein the second ends of the lines are spaced from the longitudinal axis of the pole a distance greater than a distance the first ends of the lines are spaced from the longitudinal axis.

16. A mounting system in accordance with claim 1, wherein the first ends of the lines are spaced from the longitudinal axis of the pole a distance that increases as the distance between the mounting member and the first end of the pole increases.

17. A mounting system for an antenna, comprising, in combination:

a pole having a first end and a second end and being rigidly secured at the first end;

a joint secured to the pole and being rotationally fixed with respect to the pole;

a platform for supporting the antenna operably connected to the joint;

a plurality of lines in tension spaced angularly equally around a longitudinal axis of the pole, each secured at a first end thereof to the platform and operably connected at a second end thereof to the pole.

18. A mounting system in accordance with claim 17, wherein the lines comprise flexible cables.

19. A mounting system in accordance with claim 17, wherein the lines comprise at least three lines.

20. A mounting system in accordance with claim 17, wherein the lines are substantially parallel to the longitudinal axis of the pole.

21. A mounting system in accordance with claim 17, further comprising a base to which both the first end of the pole and the second ends of the lines are secured.

22. A mounting system in accordance with claim 17, further comprising a mounting member secured to the pole intermediate the pole's first and second ends to which the second ends of the lines are secured.

23. A mounting system in accordance with claim 17, wherein the joint is secured to the pole intermediate the pole's first and second ends.

24. A mounting system in accordance with claim 23, wherein the joint comprises a gimbal.

25. A mounting system in accordance with claim 17, further comprising adjustment means to position the platform in a predetermined planar orientation.

26. A mounting system in accordance with claim 25, wherein the adjustment means comprises a turnbuckle disposed in each line.

27. A mounting system in accordance with claim 17, wherein the lines are configured such that the platform is non-horizontal when the pole is in a static vertical condition and substantially horizontal when the pole is bent from its static vertical position a predetermined angle.

28. A mounting system in accordance with claim 17, further comprising a plurality of guide members intermediate the platform and the first end of the pole operably connected to the lines.

29. A mounting system in accordance with claim 28, wherein the guide members are positioned along the line at a point other than the midpoint of said lines.

30. A mounting system in accordance with claim 28, wherein the guide members comprise a rod having a bore formed at a first end thereof through which a line passes and being secured at a second end thereof to the pole.

31. A mounting system in accordance with claim 28, wherein the guide members comprise a rod secured at a first end thereof to a line, a second end thereof being connected to a hinge member secured to the pole.

32. A mounting system for an antenna, comprising, in combination:

a pole having a first end and a second end and being rigidly secured at the first end to a base;

an joint secured to the pole intermediate the first and second ends and being rotationally fixed with respect to the pole;

a platform for supporting an antenna operably connected to the joint;

a mounting member secured to the pole intermediate the joint and the base;

three flexible cables in tension are spaced angularly equally around the pole, each secured at a first end thereof to the platform and at a second end thereof to the mounting member; and an adjustment means to position the platform in a predetermined planar orientation.

* * * * *

UNITED STATES PATENT AND TRADEMARK OFFICE

CERTIFICATE OF CORRECTION

PATENT NO. : 6,018,325
DATED : January 25, 2000
INVENTOR(S) : Carl Lundgren

It is certified that error appears in the above-identified patent and that said Letters Patent is hereby corrected as shown below:

Title Page,
Add the following references:

U.S. PATENT DOCUMENTS

| | | | | |
|---|---|---|---|---|
| 3 1 1 0 3 6 8 | 11/1963 | Ross | 189 | 26 |
| 3 6 8 9 9 2 3 | 9/1972 | Tocquec | 343 | 781 |

FOREIGN PATENT OR PUBLISHED FOREIGN PATENT APPLICATION

| | | |
|---|---|---|
| WO 81/ 0 2 4 3 8 | 9/1981 | PCT |
| WO 97/ 2 1 2 5 8 | 6/1997 | PCT |

Signed and Sealed this

Third Day of July, 2001

*Attest:*

Nicholas P. Godici

*Attesting Officer*

NICHOLAS P. GODICI
*Acting Director of the United States Patent and Trademark Office*